US011186946B2

(12) United States Patent
Robertson et al.

(10) Patent No.: US 11,186,946 B2
(45) Date of Patent: Nov. 30, 2021

(54) REFLECTIVE KNIT ARTICLE

(71) Applicant: Personal Habitat, LLC, Grand Rapids, MI (US)

(72) Inventors: Dale Robertson, Grand Rapids, MI (US); Amanda Sherlip, Nelsonville, NY (US); Samantha Burdett, Brooklyn, NY (US)

(73) Assignee: Personal Habitat, LLC, Grand Rapids, MI (US)

( * ) Notice: Subject to any disclaimer, the term of this patent is extended or adjusted under 35 U.S.C. 154(b) by 226 days.

(21) Appl. No.: 16/550,641

(22) Filed: Aug. 26, 2019

(65) Prior Publication Data

US 2021/0062413 A1 Mar. 4, 2021

(51) Int. Cl.

| | |
|---|---|
| ***D06Q 1/10*** | (2006.01) |
| ***D04B 1/10*** | (2006.01) |
| ***B05D 5/06*** | (2006.01) |
| ***D04B 1/16*** | (2006.01) |
| ***D04B 1/24*** | (2006.01) |
| ***D04B 1/12*** | (2006.01) |
| ***D04B 7/04*** | (2006.01) |

(Continued)

(52) U.S. Cl.

CPC ..... *D06Q 1/10* (2013.01); *B05D 5/063* (2013.01); *D04B 1/102* (2013.01); *D04B 1/12* (2013.01); *D04B 1/16* (2013.01); *D04B 1/24* (2013.01); *A41D 2500/10* (2013.01); *D04B 7/00* (2013.01); *D04B 7/04* (2013.01); *D04B 7/28* (2013.01)

(58) Field of Classification Search

CPC ..... D04B 1/102; D04B 1/126; D04B 1/24; D04B 1/10; D04B 1/02; D04B 1/08; D04B 7/04; D04B 7/00; D04B 7/26; D04B 7/28; D04B 7/24

See application file for complete search history.

(56) References Cited

U.S. PATENT DOCUMENTS 6,079,235 A * 6/2000 Schmidt ..... D04B 9/34 66/136

6,112,558 A 9/2000 Wang (Continued)

FOREIGN PATENT DOCUMENTS

EP 0533612 A2 * 3/1993 ..... D04B 1/102

EP 0533612 B1 11/2001

OTHER PUBLICATIONS

P. Kanakaraj, R. Ramachandran, B.S. Dasaradan (2014). Development of Multi-Layer Fabric on a Flat Knitting Machine, Journal of Engineered Fibers and Fabrics vol. 9, Issue 2—2014, pp. 25-31.

(Continued)

*Primary Examiner* — Danny Worrell
*Assistant Examiner* — Aiying Zhao
(74) *Attorney, Agent, or Firm* — Price Heneveld LLP

(57) ABSTRACT

A knit fabric is created using on a flatbed knitting machine to create a whole garment having an inner surface and an outer surface. The knit fabric includes a support matrix comprised of base yarns with reflective yarns supported on the support matrix. The knit fabric comprises a jacquard knit structure formed from the base yarns and the reflective yarns, wherein elongate loops of the reflective yarns are outwardly exposed from the outer surface of the knit fabric. The inner surface of the knit fabric includes outwardly exposed floats of the reflective yarns.

5 Claims, 6 Drawing Sheets

(51) Int. Cl.
*D04B 7/00* (2006.01)
*D04B 7/28* (2006.01)

(56) References Cited

U.S. PATENT DOCUMENTS

| | | | | |
|---|---|---|---|---|
| 6,119,487 | A * | 9/2000 | Okuno | D04B 1/106 66/75.1 |
| 6,318,131 | B1 | 11/2001 | Kobata et al. | |
| 7,707,857 | B1 * | 5/2010 | McMurray | D04B 1/104 66/196 |
| 9,689,092 | B2 | 6/2017 | Liao et al. | |
| 2007/0169517 | A1 * | 7/2007 | Shimasaki | D04B 1/126 66/64 |
| 2017/0202295 | A1 * | 7/2017 | MacGilbert | D04B 1/123 |
| 2017/0238644 | A1 * | 8/2017 | Meir | A43B 23/04 |
| 2017/0283996 | A1 * | 10/2017 | Terai | D04B 1/22 |
| 2017/0360127 | A1 * | 12/2017 | Suzuki | A41D 19/00 |
| 2018/0127915 | A1 | 5/2018 | Nowak et al. | |
| 2020/0354866 | A1 * | 11/2020 | Danby | A43B 23/0215 |
| 2020/0399798 | A1 * | 12/2020 | O'Sullivan | A41D 1/08 |

OTHER PUBLICATIONS

Wonseok Choi, Nancy B. Powell, Three Dimensional Seamless Garment Kitting on V-Bed Flat Knitting Machines, Fibre2fashion.com World of Garment—Textile Fashion, 16 Pages.

* cited by examiner

REFLECTIVE KNIT ARTICLE

FIELD OF THE INVENTION

The present disclosure generally relates to a knit article and a method of producing the same, and more specifically, to a knit article provided with a reflective component for reflecting light as a safety feature

BACKGROUND OF THE INVENTION

The risk of injury or death faced by pedestrians is an ongoing concern when pedestrians cross or share pathways frequented by motor vehicle traffic. During activities, such as walking, running or biking, pedestrians are likely to encounter motor vehicles, and such encounters can be dangerous if a pedestrian is not readily visible to a vehicle operator. Risks to pedestrians are increased in poor lighting conditions as may occur at night or during inclement weather. Reflective materials have been used to draw attention to pedestrians, but such materials often involve accessories (i.e. vests, patches, straps etc.) that do not comport to today's form fitting athletic apparel. A seamless knit article that is created using a flat knitting machine is desired that includes a reflective component while providing high support performance to the user. Traditional reflective yarn varieties for flatbed knitting pose many challenges to work with in a knit fabric, as many such yarns are susceptible to breakage due to lack of malleability and the fragile nature of a yarn having brittle reflective materials embedded therein. Further, some reflective yarns have only a single side that may be reflective and therefore are only functional when laid flat, using techniques such as inlay, in order to consistently reflect light in an overall knit fabric. As such, the present invention seeks to support and integrate a reflective yarn component into a knit article in a way that allows the knit article to be worked into a knit fabric while still functioning properly as a reflector of light.

It is an object of the present invention to provide reflective apparel of high support performance by utilizing flat knitting machine technology and reflective yarn in conjunction with a wool-polyamide blend, such that the fashioning of a knit article is one that supports a high-performance fit while providing a functioning and wearable seamless reflective product.

SUMMARY OF THE INVENTION

According to one aspect of the present disclosure, a knit article includes a knit fabric including an inner surface and an outer surface. The knit fabric includes a support matrix comprised of base yarns. The knit fabric also includes reflective yarns supported on the support matrix. The knit fabric comprises a jacquard knit structure formed from the base yarns and the reflective yarns. Elongate loops of the reflective yarns are outwardly exposed from the outer surface of the knit fabric. The inner surface of the knit fabric includes outwardly exposed floats of the reflective yarns.

According to another aspect of the present disclosure, a knit article includes a support matrix comprised of a set of base yarns. A set of reflective yarns is supported on the support matrix. Select loops of the reflective yarn from the set of reflective yarns carry over multiple loops within one course and are interconnected with loops of base yarns of the set of base yarns. The select loops of reflective yarn are outwardly exposed from an outer surface of the knit article.

An inner surface, or technical back, of the knit article includes outwardly exposed flat floats comprised of reflective yarn.

According to yet another aspect of the present disclosure, a method of making a knit article using a flat knitting machine including opposed front and back needle beds and at least two yarn feeders to feed yarn to different types of yarn to the front and back needle beds. The method includes the steps of: (1) running a first course of a base yarn along the back and front needle beds using a base yarn feeder. (2) running a second course of a reflective yarn along the back and front needle beds using a reflective yarn feeder, wherein at least two loops of the first course are floated by the reflective yarn of the second course. (3) running a third course of the base yarn along the back and front needle beds using the base yarn feeder, wherein at least two elongate loops of the second course are floated by the base yarn of the third course. (4) running a fourth course of the reflective yarn along the back and front needle beds using the reflective yarn feeder, wherein at least two elongate loops of the second course are floated by the reflective yarn of the fourth course. (5) running a fifth course of a reflective yarn along the back and front needle beds using the reflective yarn feeder, wherein at least two loops of the fourth course are floated by the reflective yarn of the fifth course.

These and other features, advantages, and objects of the present disclosure will be further understood and appreciated by those skilled in the art by reference to the following specification, claims, and appended drawings.

DETAILED DESCRIPTION OF THE PREFERRED EMBODIMENTS

Figure 1:
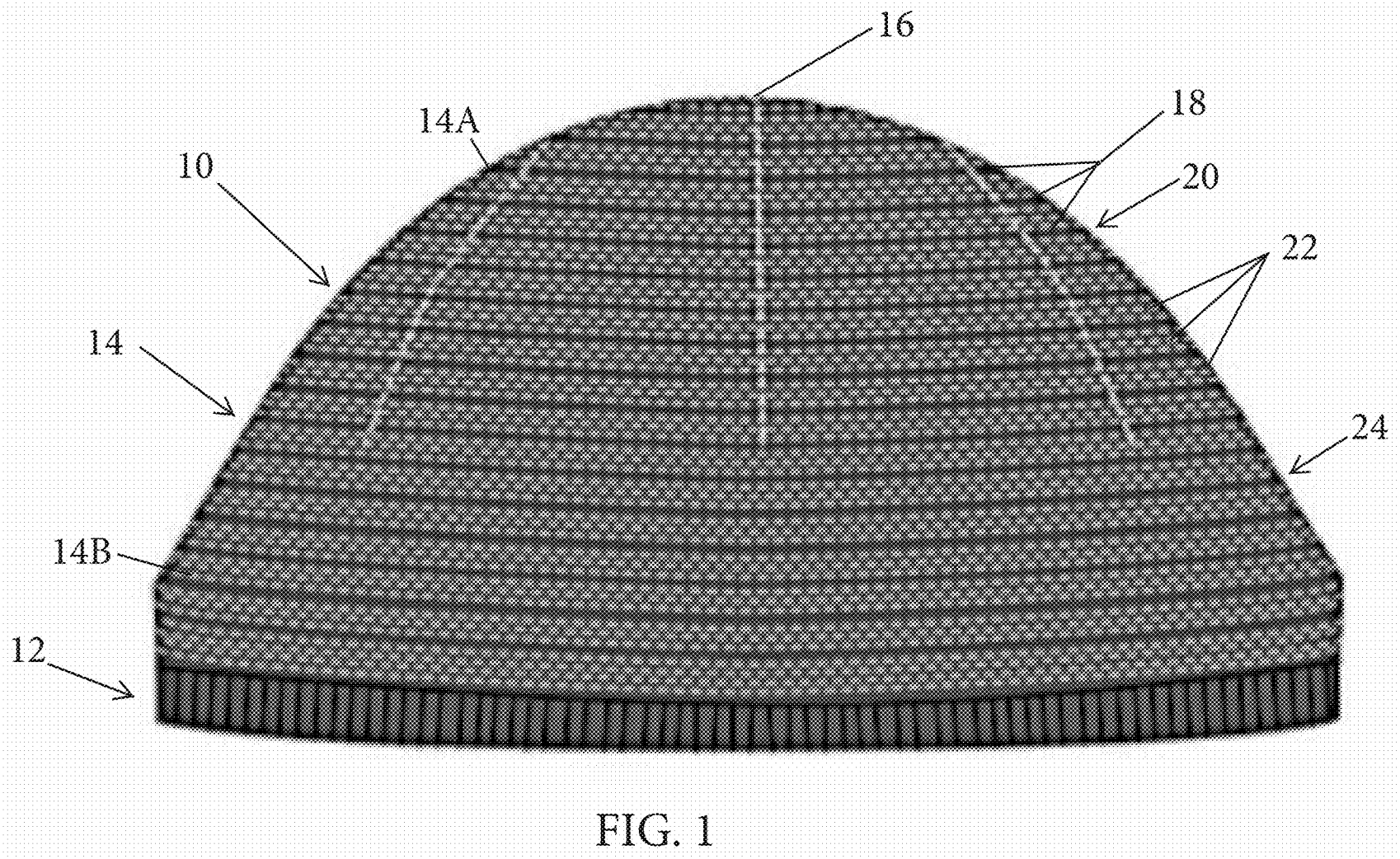
FIG. 1 is a side elevation view of a knit article according to one embodiment of the present concept.

The present illustrated embodiments reside primarily in combinations of method steps and apparatus components related to a knit article having reflective properties. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. The terms "technical front" and "technical rear" are intended herein to describe opposed surfaces of a knit article. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

The terms "reflective yarn" or "reflective component" refers to a yarn, or a component thereof, with light reflective properties. Reflective yarn may include a non-metallic filamentous core material coated with a reflective coating or a polymeric resin embedded with reflective material. Reflective yarn may also include a yarn core material embedded or coated with a reflective component, wherein the reflective component may include metal oxides, non-metal oxides, reflective polymers, glass, metal alloys, and the like, which may be provided as nanoparticles. A type of reflective yarn suitable for use with the present concept is commercially available from C.R.Y. SAS and Massebeuf Textiles SAS of France. Other reflective yarns are also contemplated for use with the present concept.

The term "flat knitting" refers to a knitting technique that requires an automated knitting machine to produce a knit article. A V-Bed knitting machine is a known knitting machine that includes front and back needle beds arranged in an inverted V-shaped formation. The front and back needle beds can have varied widths to accommodate a variety of knit articles. A carriage, also known as a cambox, cam or head, moves across the needle beds to "work" the needles to selectively, knit, tuck, miss or transfer stitches of various yarns to form a knit article. A flat knitting machine allows for shaped knitting of knit article.

Referring now to FIG. 1, an article 10 is shown in the form hat or cap. The article 10 is a knit article that is formed using a seamless forming technique further described below. The knit article 10 represents an accessory or article of clothing that is created using the presently disclosed methods, however, the present disclosure is not limited to hats or caps, but can be used to create knit articles and fabrics of various forms. As such, the knit article 10 of FIG. 1 is shown in the form of a knit hat as an exemplary embodiment of the present concept only, and is not meant to limit the present concept in any manner.

As shown in FIG. 1, the knit article 10 includes a base portion 12 and a body portion 14 disposed above an interconnected with the base portion 12. The body portion 14 is contemplated to be a shaped body portion that generally tapers from a lower portion 14B towards an upper portion 14A thereof. This process is created by the use of "fashioning" or "narrowing" stiches to shape the knit article 10 by creating a dart within the body portion 14 of the knit article 10. In the embodiment of FIG. 1, the body portion 14 of the knit article 10 culminates in a closed top portion 16. The base portion 12 of the knit article 10 is contemplated to define an open bottom portion of the knit article 10.

The knit article 10 is contemplated to be a knit article that is formed using a flat knitting process for creating a seamless knit article. As such, is contemplated that a 3D knitting technique is used to create the knit article 10 using computerized flat knitting machines, such as the knitting machines commercially available from Shima Seiki Manufacturing Limited of Wakayama, Japan. Using a 3D knitting technique, the knit article 10 can be produced in a seamless manner and having the contoured shapes necessary for proper fit and comfort.

As further shown in FIG. 1, the base portion 12 of the knit article 10 is contemplated to be comprised of a set of base yarns 18 having a wool component. Specifically, the base yarns 18 for use with the present concept are contemplated to be comprised of a blend of wool and synthetic components to provide a blend that gives the effect for which the wool content will expand after washing to provide comfort from the heat of wetting or sorption, washability, antimicrobial and odor absorbing properties. The synthetic component of the blend may include a polyamide component, such as aramid, polyester or nylon fibers, that is blended with the wool for durability and strength. The entirety of the base portion 12 may be comprise of base yarns knit in a rib structure, such as a 1×1 rib structure, a 2×2 rib structure, or a 2×1 ribs structure. In the embodiment shown in FIG. 1, the base portion 12 is contemplated to be configured in a 2×2 rib structure provided by a pattern calling for two consecutive stitches knit in front jersey followed by two consecutive stitches knit in reverse jersey.

The base yarns 18 are also provided in the body portion 14 of the knit article 10. In the body portion, the base yarns 18 are configured to provide a support matrix 20 upon which a set of reflective yarns 22 are supported. Specifically, the reflective yarns 22 are knit into the support matrix 20 of the base yarns 18 in a predetermined pattern which provides for exposed strands of the reflective yarn 22 to be exposed on a technical front, or outer surface 24, of the knit article 10. Throughout the repeat pattern of the knit article 10, it is contemplated that the knit article 10 will comprise form about 30-40% reflective yarn 22 and about 60%-70% base yarn 18. The reflective yarn 22 for use with the present concept is contemplated to include a core material having a reflective coating provided on and surrounding an outer surface of the core material. The reflective coating may include a polymer matrix having reflective materials disposed on a peripheral surface of the polymer matrix. The reflective materials may include a reflective metal, a reflective nonmetal oxide, a reflective polymer, and other such reflective materials and combinations thereof. Having the reflective materials, such as those noted above, the reflective yarn reflects more light than the base yarn. A reflective yarn contemplated for use with the present concept is commercially available from C.R.Y. SAS of Romans-sur-Isere, France and is sold under the name CRY® coated reflective yarn and JRC-REFLEX®. A reflective yarn contemplated for use with the present concept is disclosed in U.S. Patent Application Publication Number 2018/0127915, the entirety of which is hereby incorporated by reference. However, other light reflecting yarns may be used with the present concept. In FIG. 1, the base yarns 18 are illustrated as darker yarns as compared to the lighter colored reflective yarns 22.

Figure 2:
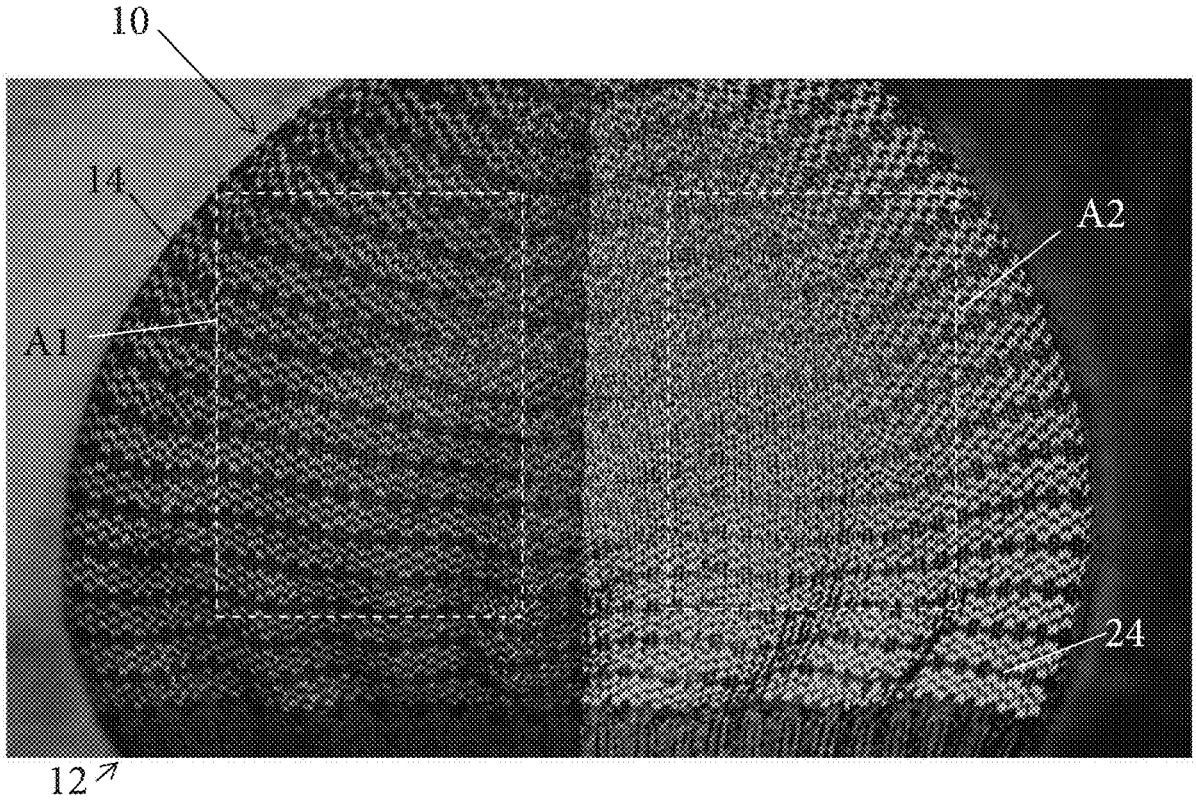
FIG. 2 is a photograph of a knit article showing a first area provided in daylight conditions and a second area illuminated by a light source.

Referring now to FIG. 2, the knit article 10 is shown from the outer surface 24 thereof. The knit article 10 of FIG. 2 is shown as divided into areas A1 and A2. In area A1, the knit article 10 is shown in standard daylight conditions. In area A2, the knit article 10 is shown as being illuminated by a light source to provide a reflective property provided by the reflective yarn 22 discussed above. In this way, the knit article 10 of the present concept is contemplated to provide a reflective knit fabric that can be used as a safety article to help identify pedestrians when exposed to an illumination source, such as vehicle headlights.

Figure 3:
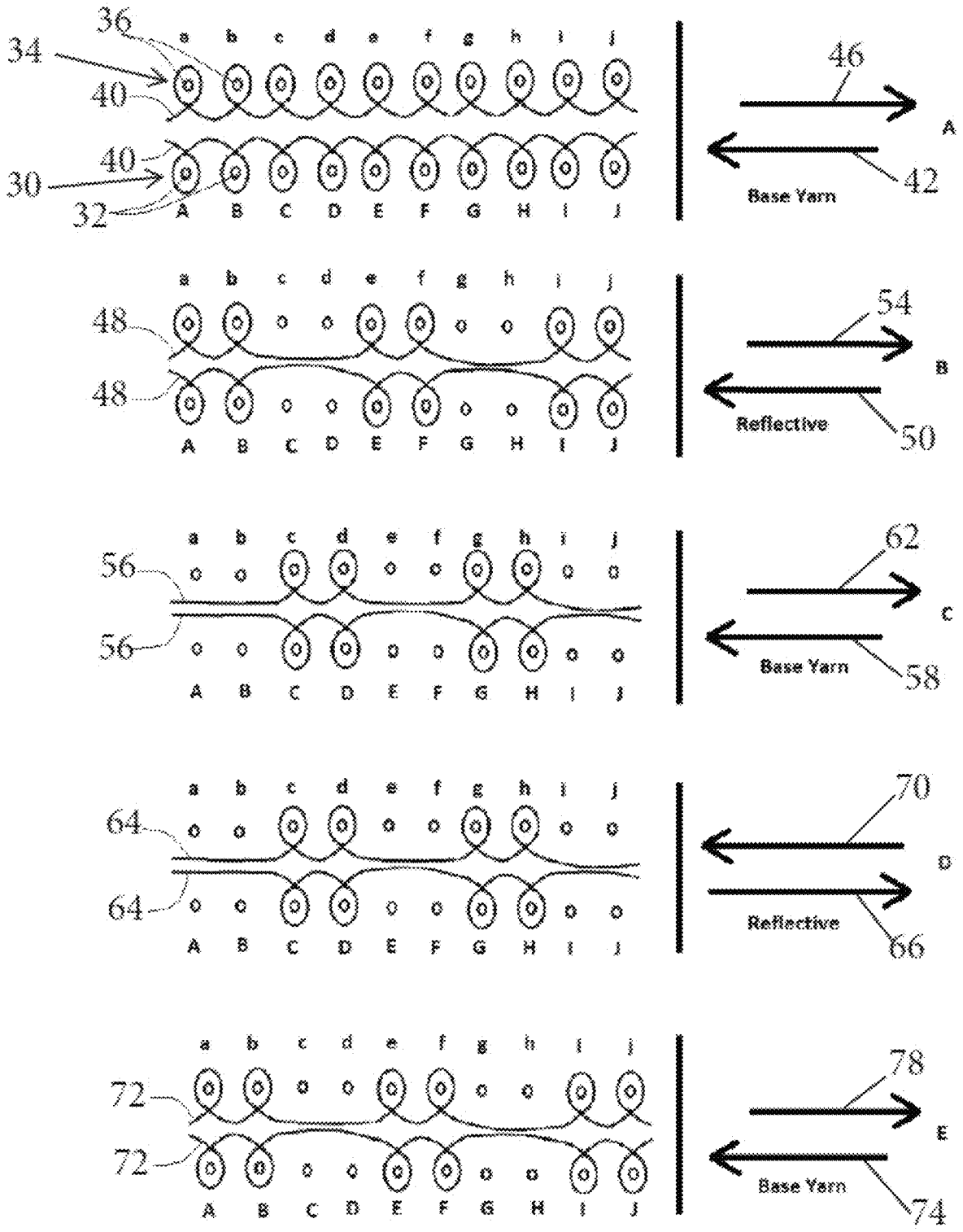
FIG. 3 is an illustrated knit sequence of courses for knitting a knit article according to the present concept.

Referring now to FIG. 3, a plurality of courses A through E are shown for providing a knit sequence for creating a knit article 10 according to the present concept. The courses A through E are contemplated to be provided on a dual V-bed flat knitting machine, such that the description of the structural elements (needles and beds) of course A will also described the structural elements used in courses B-E. The knitting machine will likely include numerous needles on the front and back beds thereof, however, the courses A-E shown in FIG. 3 are intended to illustrate a portion of a fabric that includes a predetermined knit pattern with which the reflective yarn 22 of the present concept is supported on the support matrix 20 of the base yarn 18.

Figure 4:
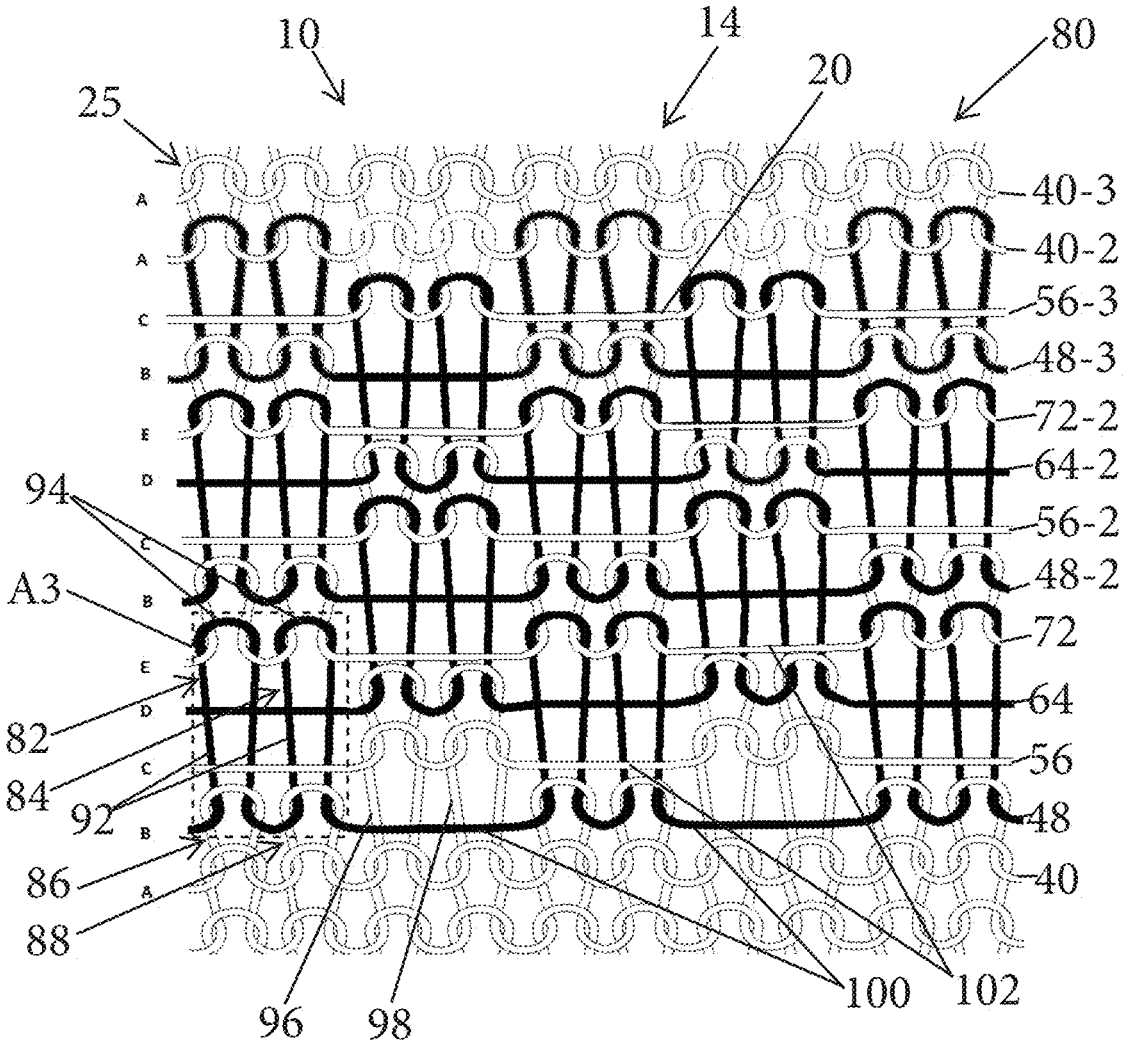
FIG. 4 is a representation of an inner surface of a knit fabric provided by the knit sequence of FIG. 3.
Figure 5:
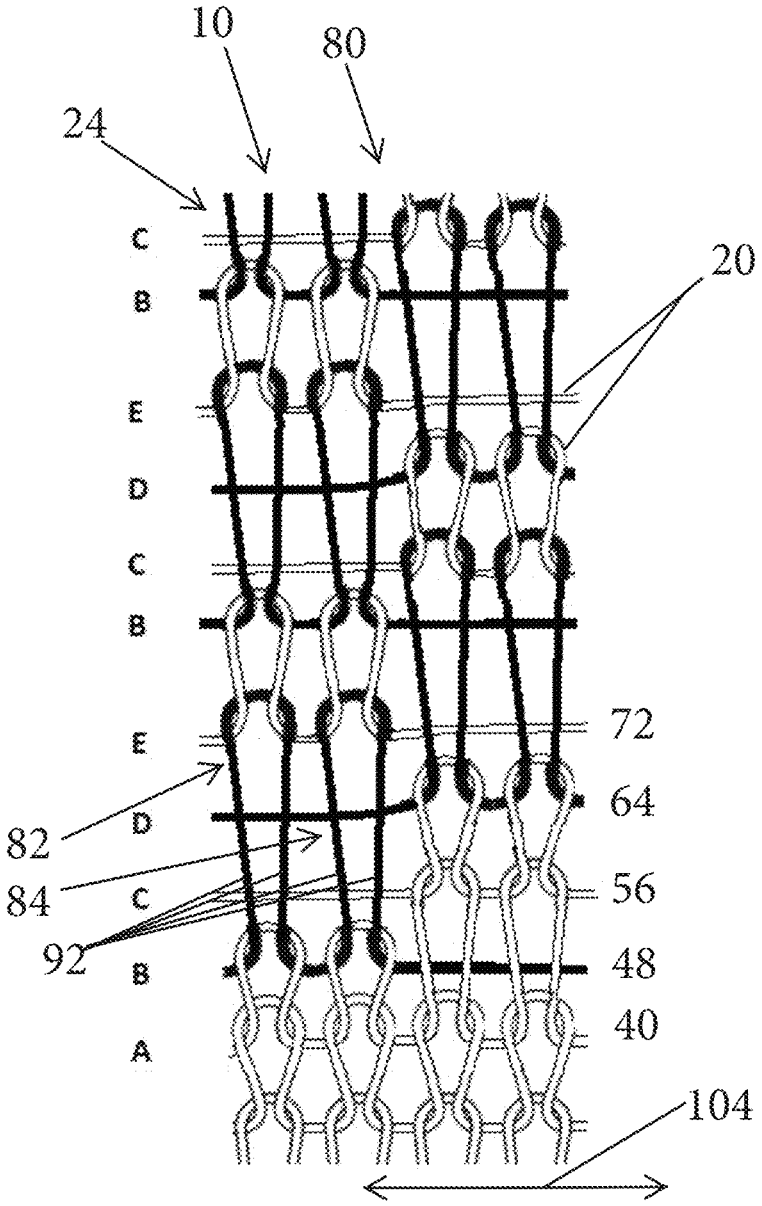
FIG. 5 is a representation of an outer surface of the knit fabric of FIG. 4.

With specific reference to course A, a front needle bed is designated by reference numeral 30 and is shown having needles 32 denoted as needles A-J. Course A further includes a back needle bed 34, or rear needle bed, having needles 36 denoted as needles a-j. In course A, a base yarn 40 is run from right to left as indicated by arrow 42 and fed to needles A-J of the front bed 30 to do the technical front knitting of a knit fabric 80 (FIGS. 4 and 5). As further shown in course A, another the base yarn 40 is run from left to right as indicated by arrow 46 and fed to needles a-j of the back bed 34 to do the technical back knitting of the knit fabric 80. It is contemplated that all ends of yarn provide in FIG. 3 are run using a carriage or feeder provided in a flat knitting machine.

In course B, a reflective yarn 48 is run from right to left as indicated by arrow 50 and fed to needles A-B, E-F and I-J of the front bed 30, such that needles A, B, E, F, I and J are the only needles interactively knit with the reflective yarn 48 to do the technical front knitting of a knit fabric 80. The remaining needles C, D, G, H do not participate in the knitting of course B, but remain floating. The interactive knitting of needles A, B, E, F, I and J of the reflective yarn 48 shown in course B create elongate loops 82, 84 (FIGS. 4 and 5) of reflective yarn that interlink with a base yarn 72 of course D of the support matrix 20 of base yarn, as further described below. The non-knitting needles C, D, G, H create float stitches 100 disposed on an inner surface 25 of the knit fabric 80, as shown in FIG. 4. As further shown in course B, the reflective yarn 48 is run from left to right as indicated by arrow 54 and fed to needles a-b, e-f, and i-j of the back bed 34 to do the technical back knitting of the knit fabric 80 in the same manner as provided in course B with reference to the front bed 30.

With further reference to FIG. 3, course C is shown, wherein a base yarn 56 is run from right to left as indicated by arrow 58 and fed to needles C, D and G, H of the front bed 30, such that needles C, D, G, H are the only needles interactively knit with the base yarn 56 to do the technical front knitting of the knit fabric 80. The remaining needles A, B, E, F, I and J do not participate in the knitting of course C, but remain floating. The interactive knitting of needles C, D, G, H of the base yarn 56 shown in course C create loops of base yarn that interlink with a reflective yarn 64 provided in course D. The non-knitting needles A, B, E, F, I and J create float stitches disposed on the inner surface 102 of the knit fabric 80, as shown in FIG. 4. As further shown in course C, the base yarn 56 is run from left to right as indicated by arrow 62 and fed to needles c-d and g-h of the back bed 34 to do the technical back knitting of the knit fabric 80 in the same manner as provided in course C with reference to the front bed 30.

With further reference to FIG. 3, course D is shown, wherein a reflective yarn 64 is run from right to left as indicated by arrow 66 and fed to needles C, D and G, H of the front bed 30, such that needles C, D, G, H are the only needles interactively knit with the reflective yarn 64 to do the technical front knitting of the knit fabric 80. The remaining needles A, B, E, F, I and J do not participate in the knitting of course D, but remain floating. The interactive knitting of needles C, D, G, H of the reflective yarn 64 shown in course D create elongate loops 82, 84 (FIGS. 4 and 5) of reflective yarn that interlink with a base yarn, such as base yarn 56 of a second course of C in a knitting sequence. The non-knitting needles A, B, E, F, I and J create float stitches 100 of reflective yarn disposed on the inner surface 25 of the knit fabric 80, as shown in FIG. 4. As further shown in course D, the reflective yarn 64 is run from left to right as indicated by arrow 70 and fed to needles c-d and g-h of the back bed 34 to do the technical back knitting of the knit fabric 80 in the same manner as provided in course D with reference to the front bed 30.

With further reference to FIG. 3, course E is shown, wherein a base yarn 72 is run from right to left as indicated by arrow 74 and fed to needles A-B, E-F and I-J of the front bed 30, such that needles A, B, E, F, I and J are the only needles interactively knit with the base yarn 72 to do the technical front knitting of a knit fabric 80. The remaining needles C, D, G, H do not participate in the knitting of course E, but remain floating. The interactive knitting of needles A, B, E, F, I and J of the base yarn 72 shown in course E create loops 96, 98 (FIG. 4) of base yarn that interlink with a reflective yarn in a second course of B. The non-knitting needles C, D, G, H create float stitches 102 of base yarn disposed on an inner surface 25 of the knit fabric 80, as shown in FIG. 4. As further shown in course E, the base yarn 72 is run from left to right as indicated by arrow 78 and fed to needles a-b, e-f, and i-j of the back bed 34 to do the technical back knitting of the knit fabric 80 in the same manner as provided in course B with reference to the front bed 30.

The knitted repeat shown in FIG. 3 includes courses that are contemplated to be run in a knit sequence comprised of courses A, B, C, D, E, B, C, D, E, B, C, A run consecutively and repeatedly to create the body portion 14 of the knit article 10 shown in FIG. 1. With the knit sequence provided above, the knit fabric 80 is created having a predetermined pattern of reflective yarn 22 supported on the support matrix 20 of the base yarn 18. It is contemplated that the body portion 14 of the knit article 10 can be shaped by modifying each loop and the number of active needles per course as necessary to provide the desired shaping affect by utilizing different narrowing knitting techniques to create fashioning of the body 14. The resulting knit sequence provides for the knit fabric 80 as shown from a technical back in FIG. 4. In FIG. 4, the knit fabric 80 is contemplated to illustrate the knit sequence and pattern of the body portion 14 of the knit article 10 from a technical back or inner surface 25 of the knit article 10. The knit fabric 80 illustrated in FIG. 4 is only contemplated to show a representative portion of the knit article 10, and is not intended to designate any specific area of the body portion 14.

In FIG. 4, reflective yarn is shown supported on the support matrix 20 comprised of the base yarns. Specifically, the set of reflective yarns 22, collectively discussed above, is shown in the form of reflective yarn ends 48, 48-2, 64 and 64-2 of respective and repeated courses B and D. The set of base yarns 18, collectively discussed above, is shown in the form of base yarn ends 40, 56, 72, 56-2, 72-2, 56-3, 40-2 and 40-3 of respective and repeated courses A, C, E, C, E, C, A and A. In this way, the base yarn ends 40, 56, 72, 56-2, 72-2, 56-3, 40-2 and 40-3 of FIG. 4 provide the support matrix 20 upon which the reflective yarns 48, 48-2, 64 and 64-2 are collectively supported. As shown in FIG. 4, the reflective yarns 48, 48-2, 64 and 64-2 are knit into the support matrix 20 in a predetermined pattern which provides for elongate loops of reflective yarn. With specific reference to the reflective yarn 48 shown in the first course of B, elongate loops 82, 84 are provided which are interconnected to loops 86, 88 of the base yarn 40 of course A at feet 90 of the elongate loops 82, 84. The elongate loops 82, 84 further include leg portions 92 which culminate in heads 94. The heads 94 of the elongate loops 82, 84 are operably coupled to the support matrix 20 at base yarn 72 of first course of E. In this way, the elongate loops 82, 84 of the first course of B span courses C and D to interconnect with the base yarn 72 of the first course of E. From the elongate loops 82, 84 of course B, the reflective yarn 48 of course B floats respective loops 96, 98 of course A to provide a float stitch 100 that is visible from the inner surface 25 of the knit fabric 80. Similarly, float stitches 102 of the base yarns, such as base yarns 56, 72, are shown as being visible from the inner surface 25 of the knit fabric 80 by floating over the elongate loops of the reflective yarn 22. The loops 82, 84 are considered elongate loops, in that multiple courses float the needles of the loops to create elongate loops 82, 84. As shown in FIG. 4, elongate loops 82, 84 are floated by the base yarn 56 and reflective yarn 64 of courses C and D, respectively, to provide for a vertically elongate loop structure for the elongate loops 82, 84 that provides a condensed and repeated collection of four leg portions 92 (FIG. 5) together to provide a concentrated area of reflective yarn for effectively reflecting light.

Referring now to FIG. 5, the elongate loops 82, 84 of reflective yarn 48 of course B are shown having the upwardly extending leg portions 92 thereof exposed from the outer surface 24 of the knit fabric 80 and spanning the base yarn 56 and reflective yarn 64 of courses C and D, respectively. In this way, the exposure of the reflective yarn 22 of the present concept is maximized to provide suitable visibility for using the knit article 10 as a reflective safety article. As noted above, the coatings and reflective materials used to provide a reflective yarn makes for a yarn that is generally not suitable for standard knitting conditions given its fragility and unmalleable nature. However, using the support matrix 20 provided by the base yarns 18 of the present concept, the reflective yarn 22 can be supported in a way that allows for the reflective yarn 22 to move with the base yarn 18 in a direction as indicated by arrow 104 when the support matrix 20 is stretched without creating too much tension on the reflective yarn 22 that could possibly damage the fragile reflective yarn 22. In this way, the support matrix 20 provided by the base yarn 18 encapsulates the reflective yarn 22 to protect the same under normal use and wear conditions.

Figure 6:
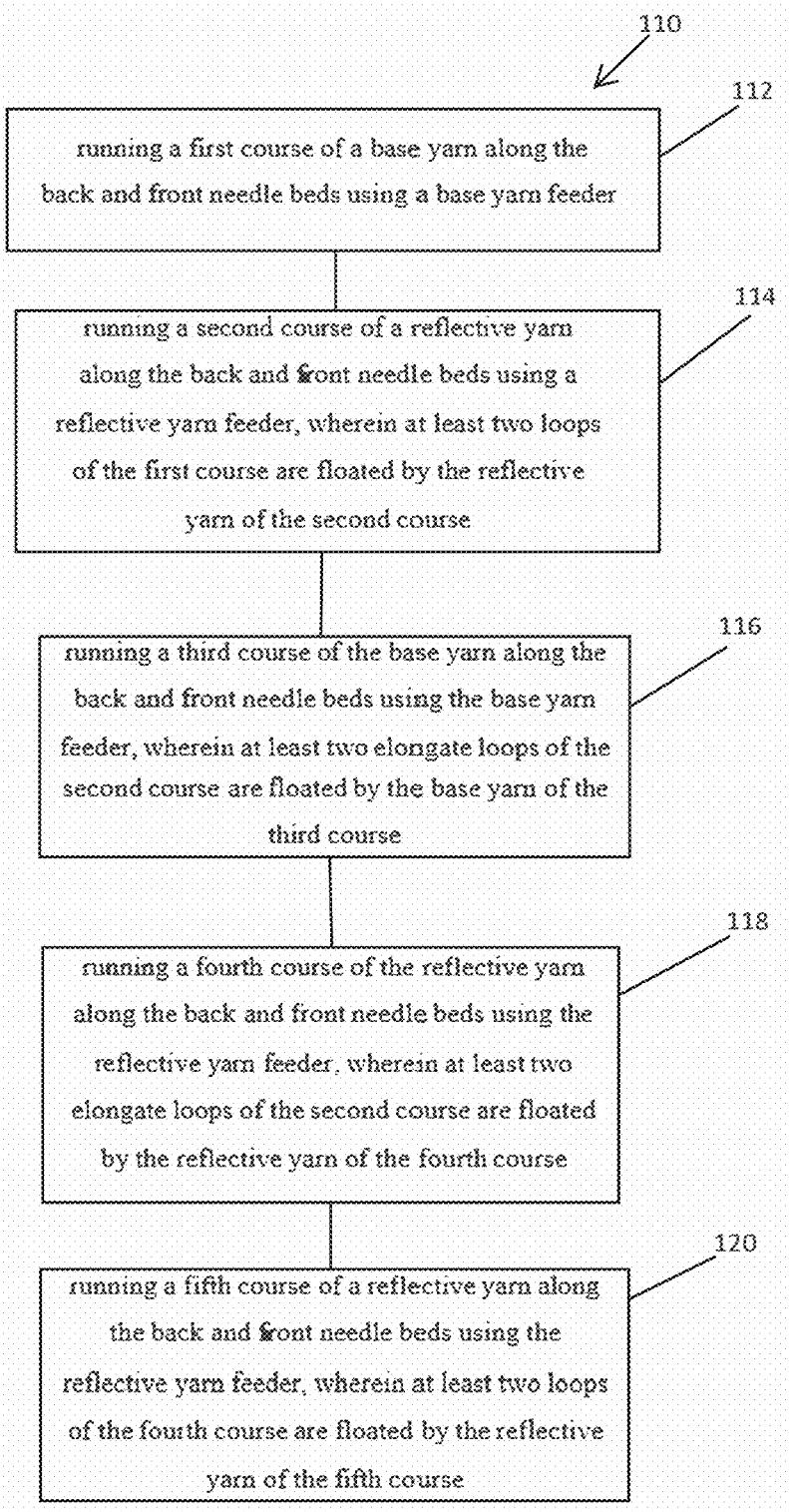
FIG. 6 is a flow chart of a method of making a knit article.

The present concept further includes a method 110 of making a knit article using a flat knitting machine as shown in FIG. 6. The flatbed knitting machine used with the method 110 of the present concept is contemplated to have opposed front and back needle beds and at least two yarn feeders (cams, cam-boxes, runners) to feed base yarn and reflective yarn to the front and back needle beds for creating the knit article. The method 110 includes a first step 112 which involves running a first course of a base yarn along the back and front needle beds using a base yarn feeder to build technical front and technical rear portions of a body portion of a knit article, such as the body portion 14 of the knit article 10 shown in FIG. 1. The base yarn may include a base yarn much like base yarn 18 described above. The first step 112 may be executed numerous times to create a support matrix, such as support matrix 20 described above, upon which a reflective yarn may be supported. The first step 112 may be executed numerous times consecutively to build up the body portion of a knit article having a 2×2 rib pattern. It is further contemplated that the first course of the first step 112 of the method 110 may include a jersey/reverse jersey pattern.

As further shown in FIG. 6, a second step 114 of the method 110 may include running a second course of a reflective yarn along the back and front needle beds using a reflective yarn feeder. The reflective yarn may include a reflective yarn much like reflective yarn 22 described above. It is contemplated that at least two loops of the first course of first step 112 are floated by the reflective yarn of the second course in the second step 114 of the method 110. A third step 116 of the method 110 includes running a third course of the base yarn along the back and front needle beds using the base yarn feeder, wherein at least two elongate loops of the second course are floated by the base yarn of the third course. A fourth step 116 of the method 110 includes running a fourth course of the reflective yarn along the back and front needle beds using the reflective yarn feeder, wherein at least two elongate loops of the second course are floated by the reflective yarn of the fourth course. Finally, a fifth step 118 of the method 110 includes running a fifth course of a reflective yarn along the back and front needle beds using the reflective yarn feeder, wherein at least two loops of the fourth course are floated by the reflective yarn of the fifth course.

It is further contemplated that the method can be executed by running the first course, the second course, the third course, the fourth course, the fifth course, the second course, the third course, the fourth course, the fifth course, the second course, the third course and the first course consecutively to define a knit sequence, such as the knit sequence comprised of courses A, B, C, D, E, B, C, D, E, B, C, A described above with reference to FIGS. 3 and 4. The knit sequence can be repeated to provide a knit fabric having a technical front and a technical back, in a manner as described above. Further, it is contemplated that the elongate loops of the second course of the reflective yarn are outwardly exposed along the technical front of the knit fabric.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A method of making a knit article using a flat knitting machine having opposed front and back needle beds and at least two yarn feeders to feed a base yarn and a reflective yarn to the front and back needle beds, wherein the reflective yarn reflects more light than the base yarn, the method comprising the steps of:

knitting a first course of the base yarn in the back and front needle beds using a base yarn feeder;

knitting a second course of the reflective yarn in the back and front needle beds using a reflective yarn feeder, wherein at least two loops of the first course are floated by the reflective yarn of the second course;

knitting a third course of the base yarn in the back and front needle beds using the base yarn feeder, wherein at least two elongate loops of the second course are floated by the base yarn of the third course;

knitting a fourth course of the reflective yarn in the back and front needle beds using the reflective yarn feeder, wherein the at least two elongate loops of the second course are floated by the reflective yarn of the fourth course; and knitting a fifth course of the reflective yarn in the back and front needle beds using the reflective yarn feeder, wherein at least two loops of the fourth course are floated by the reflective yarn of the fifth course.

2. The method of claim 1, including the step of:

knitting the first course multiple times consecutively to create a 2×2 rib pattern, and further wherein the first course includes a jersey/reverse jersey pattern.

3. The method of claim 1, including the step of:

knitting the first course, the second course, the third course, the fourth course, the fifth course, the second course, the third course, the fourth course, the fifth course, the second course, the third course and the first course consecutively to define a knit sequence.

4. The method of claim 3, including the step of:

repeating the knit sequence to provide a knit fabric having a technical front and a technical back.

5. The method of claim 4, wherein the at least two elongate loops of the second course are at least partially outwardly exposed along the technical front of the knit fabric.

* * * * *